US007946147B2

(12) United States Patent
Shimai et al.

(10) Patent No.: US 7,946,147 B2
(45) Date of Patent: May 24, 2011

(54) TUBE EXPANDING METHOD AND APPARATUS OF DAMPER TUBE

(75) Inventors: Kenichi Shimai, Gyoda (JP); Toshio Ogura, Gyoda (JP)

(73) Assignee: Showa Corporation, Gyoda-shi (JP)

( * ) Notice: Subject to any disclaimer, the term of this patent is extended or adjusted under 35 U.S.C. 154(b) by 487 days.

(21) Appl. No.: 12/139,479

(22) Filed: Jun. 15, 2008

(65) Prior Publication Data

US 2009/0152065 A1 Jun. 18, 2009

(30) Foreign Application Priority Data

Dec. 13, 2007 (JP) ..... 2007-322620

(51) Int. Cl.
*B21D 41/02* (2006.01)

(52) U.S. Cl. ..... 72/370.03; 72/370.01; 72/370.06; 72/393

(58) Field of Classification Search ..... 72/349, 72/370.01, 370.03, 370.06, 370.07, 370.08, 72/370.1, 370.11, 393, 465.1, 466.7, 466.8
See application file for complete search history.

(56) References Cited

U.S. PATENT DOCUMENTS

| | | | | | |
|---|---|---|---|---|---|
| 2,726,704 | A | * | 12/1955 | Fischer | 72/45 |
| 3,585,701 | A | * | 6/1971 | Stary | 29/706 |
| 4,297,867 | A | * | 11/1981 | Masaki et al. | 72/347 |
| 5,752,313 | A | * | 5/1998 | Gaffaney et al. | 29/727 |
| 6,360,415 | B1 | * | 3/2002 | Wada et al. | 29/283.5 |

FOREIGN PATENT DOCUMENTS

| | | | |
|---|---|---|---|
| JP | 61-56746 | * | 3/1986 |
| JP | HEI 6-328176 | | 11/1994 |

* cited by examiner

*Primary Examiner* — Edward Tolan
(74) *Attorney, Agent, or Firm* — Babcock IP, PLLC

(57) ABSTRACT

In a tube expanding apparatus of a damper tube supporting a thrust force of a punch applied to the damper tube by a stopper at a time of retaining one end of the damper tube by the stopper, inserting the other end of the damper tube to a die, inserting the punch to the other end of the damper tube so as to propel, and expand the other end of the damper tube while carrying out an ironing operation, the apparatus is provided with a stopper releasing means for releasing the stopper at a time when a load in an axial direction applied to the damper tube due to an elongation by the ironing work of the damper tube increases over a critical load which is previously determined to be a smaller load than an expected buckling load in the damper tube.

4 Claims, 4 Drawing Sheets

TUBE EXPANDING METHOD AND APPARATUS OF DAMPER TUBE

BACKGROUND OF THE INVENTION

1. Field of the Invention

The present invention relates to a tube expanding method and apparatus for manufacture of a damper tube.

2. Description of the Related Art

A damper tube of a hydraulic shock absorber is structured, as described in Japanese Patent Application Laid-Open (JP-A) No. 6-328176 (patent document 1), such that a rod guide and an oil seal are fixed by tube expanding a tube end opening portion of a thin tube (for example, having a thickness of 1.8 mm or less), incorporating the rod guide and the oil seal to the expanded opening portion, and caulking the tube end.

A conventional tube expanding apparatus of a damper tube supports a thrust force of a punch applied to the damper tube while holding one end of the damper tube by a stopper, inserting the other end of the damper tube to a die, inserting a punch to the other end of the damper tube so as to propel, and tube expanding the other end of the damper tube while ironing.

Since the ironing work of the tube end of the damper tube results in a tube end with a thickness that is somewhat thin, the damper tube is elongated to the thinned amount of the tube end (for example, about 2 to 3 mm). In the conventional art, since the stopper retaining one end of the damper tube is fixed, a load in an axial direction applied to the damper tube is increased due to the elongation caused by the ironing work of the damper tube. If the load reaches a buckling load of the damper tube, the damper tube is buckled. Therefore a means for constraining an inner diameter or an outer diameter of the damper tube approximately in a whole length so as to prevent the buckling of the damper tube is typically applied.

SUMMARY OF THE INVENTION

An object of the present invention is to tube expand a damper tube without buckling.

The present invention relates to a tube expanding method of a damper tube supporting a thrust force of a punch applied to the damper tube by a stopper while retaining one end of the damper tube by the stopper, inserting the other end of the damper tube to a die, inserting the punch to the other end of the damper tube so as to propel, and expanding the other end of said damper tube while carrying out an ironing operation. The method releases the stopper at a time when a load in an axial direction applied to said damper tube due to an elongation by the ironing work of the damper tube increases over a critical load which is previously determined so as to be a smaller load than an expected buckling load of the damper tube.

Further, the present invention relates to a tube expanding apparatus of a damper tube supporting a thrust force of a punch applied to the damper tube by a stopper while retaining one end of the damper tube by the stopper, inserting the other end of the damper tube to a die, inserting the punch to the other end of the damper tube so as to propel, and expand the other end of said damper tube while carrying out an ironing operation. The apparatus is provided with a stopper releasing means for releasing the stopper at while a load in an axial direction applied to said damper tube due to an elongation by the ironing operation of the damper tube increases over a critical load which is previously determined so as to be a smaller load than an expected buckling load of the damper tube.

BRIEF DESCRIPTION OF THE DRAWINGS

The present invention will be more fully understood from the detailed description given below and from the accompanying drawings which should not be taken to be a limitation on the invention, but are for explanation and understanding only.

DESCRIPTION OF THE PREFERRED EMBODIMENTS

Figure 1:
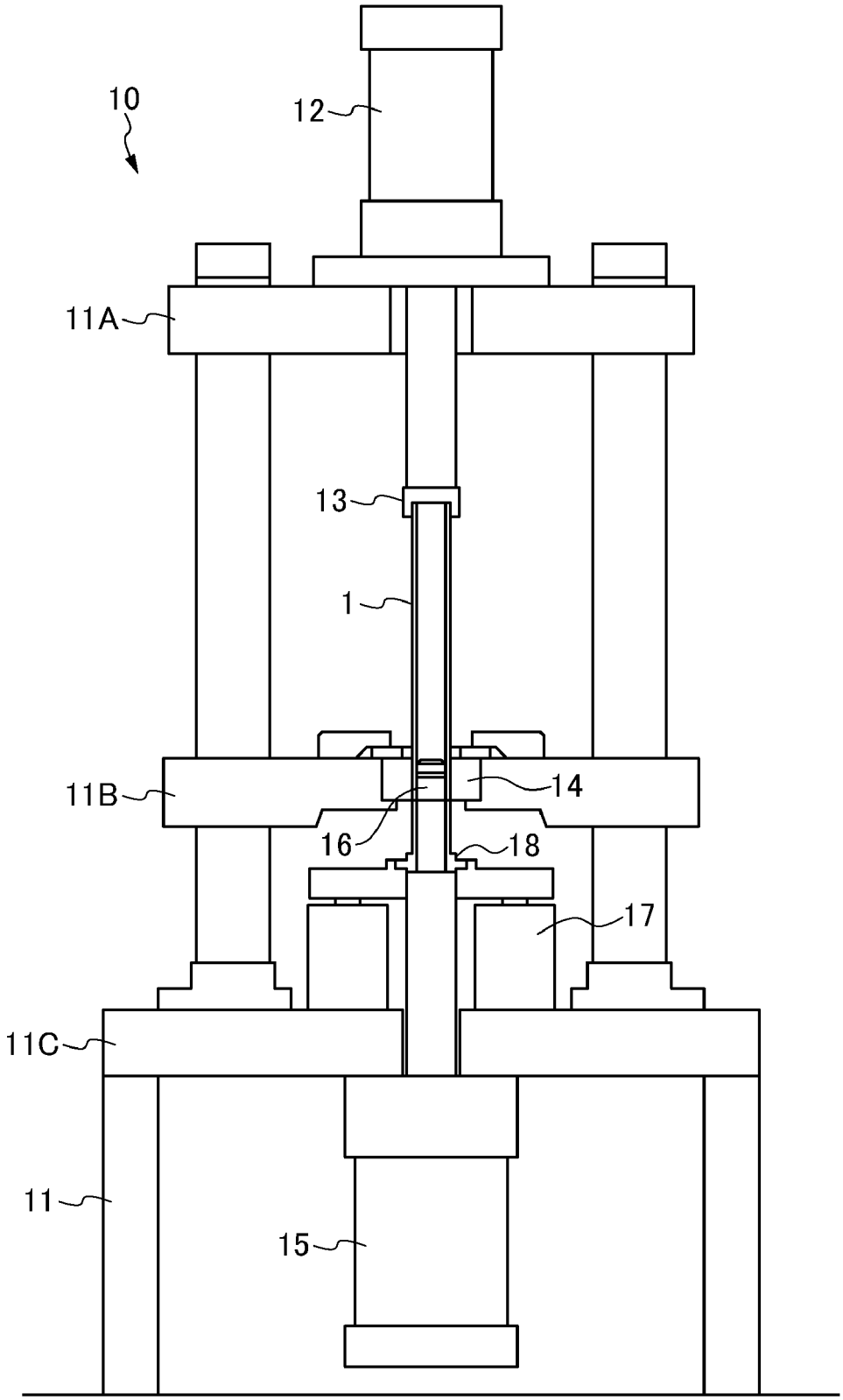
FIG. 1 is a schematic view showing a tube expanding apparatus.

A tube expanding apparatus 10 shown in FIG. 1 is structured such that a hydraulic cylinder apparatus 12 (a fluid pressure cylinder apparatus) for a stopper is fixed to an upper surface of a receiving table 11A in an upper portion of a stand 11, and a stopper 13 is provided in a leading end of a piston rod of the stopper hydraulic cylinder apparatus 12. The tube expanding apparatus 10 fixedly retains a die 14 to a receiving table 11B in an intermediate portion of the stand 11. The tube expanding apparatus 10 is structured such that a punch hydraulic cylinder apparatus 15 is fixed to a lower surface of a receiving table 11C in a lower portion of the stand 11, and a punch 16 is provided in a leading end of a piston rod of the punch hydraulic cylinder apparatus 15. The tube expanding apparatus 10 is structured such that an ejector hydraulic cylinder apparatus 17 is fixed to an upper surface of the receiving table 11C of the stand 11, and an ejector 18 is provided in a leading end of a piston rod of the ejector hydraulic cylinder apparatus 17. An inner diameter of the ejector 18 forms a guide hole of the punch 16, and an outer diameter of the ejector 18 is inserted to an inner diameter of the die 14 so as to push out the damper tube 1 after being expanded.

Figure 3:
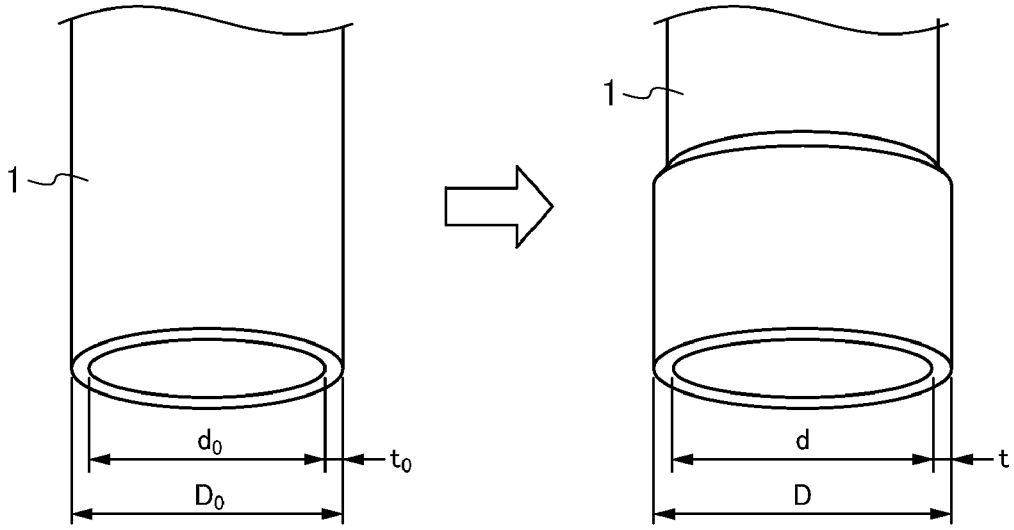
FIG. 3 is a schematic view showing a tube expanded state of a damper tube.

In other words, the tube expanding apparatus 10 is structured such as to expand a tube end opening portion of an element tube (an outer diameter D0, an inner diameter d0 and a thickness t0) of the damper tube 1 (for example, a thin steel tube having a thickness of 1.8 mm or less) in accordance with the following procedure (FIG. 3).

Figure 2:
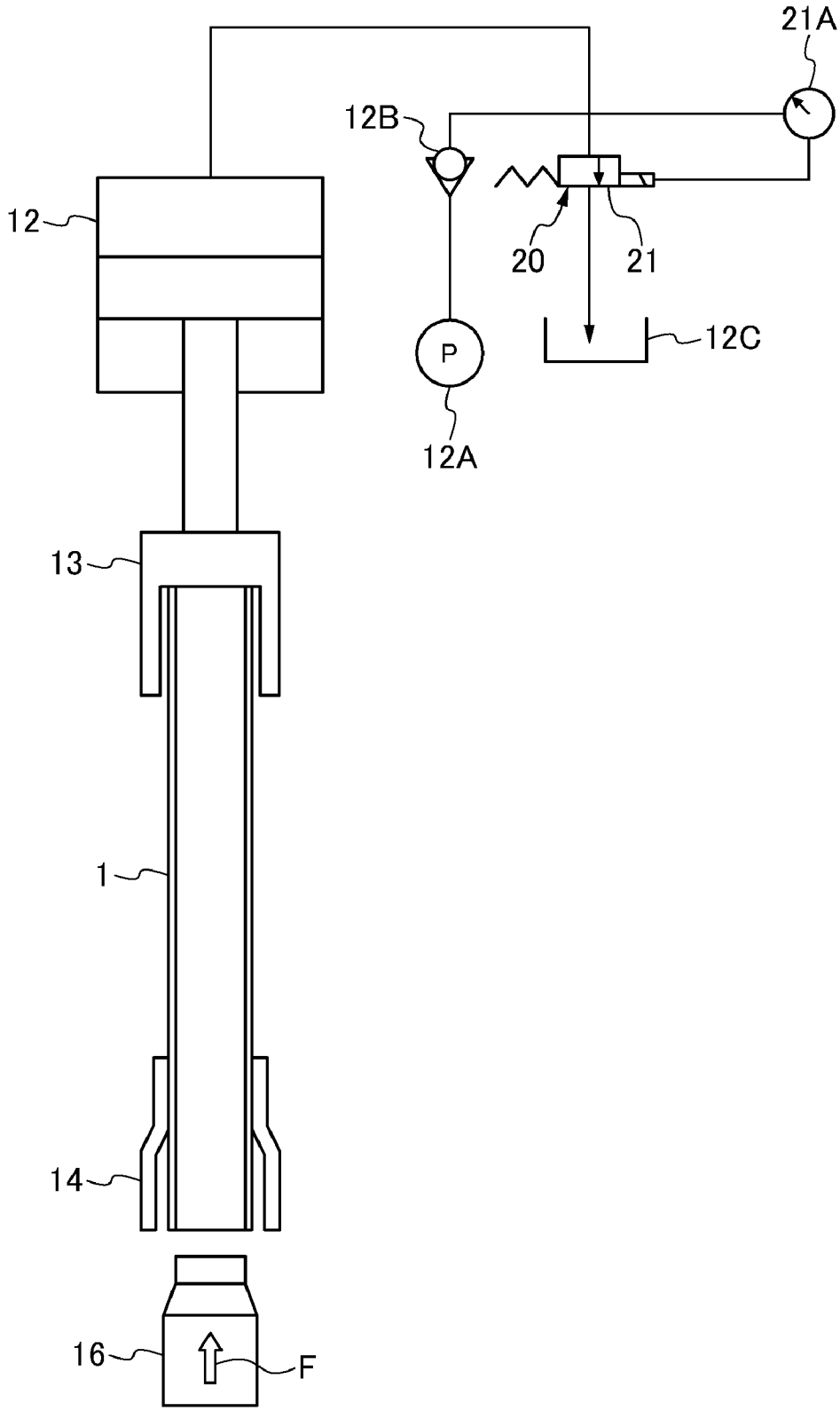
FIG. 2 is a schematic view showing one example of a stopper releasing means.
Figure 5A:
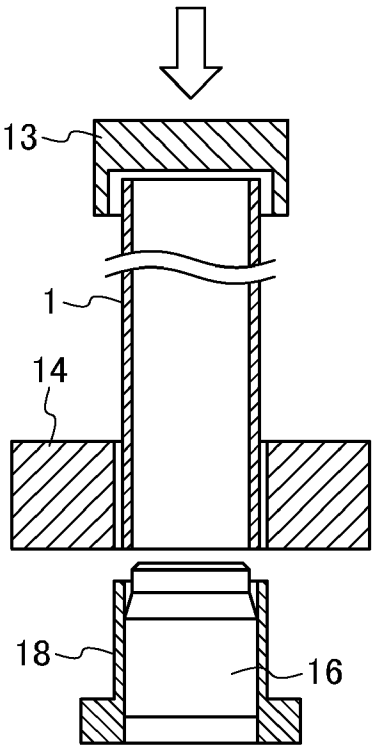
FIGS. 5A to 5D are schematic views showing a motion of the tube expanding apparatus.

(1) One end of the damper tube 1 is brought into contact with the stopper 13 supported to the stopper hydraulic cylinder apparatus 12 so as to be retained, and the other end of the damper tube 1 is inserted to the die 14 (FIG. 5A). At this time, the stopper hydraulic cylinder apparatus 12 is fed a discharge oil of the pump 12A to an oil chamber via a check valve 12B so as to be elongated, sets the stopper 13 to a fixed position corresponding to a length of the damper tube 1, and thereafter is locked against contraction on the basis of a discharge stop of the pump 12A and a check operation of the check valve 12B (FIG. 2).

Figure 4:
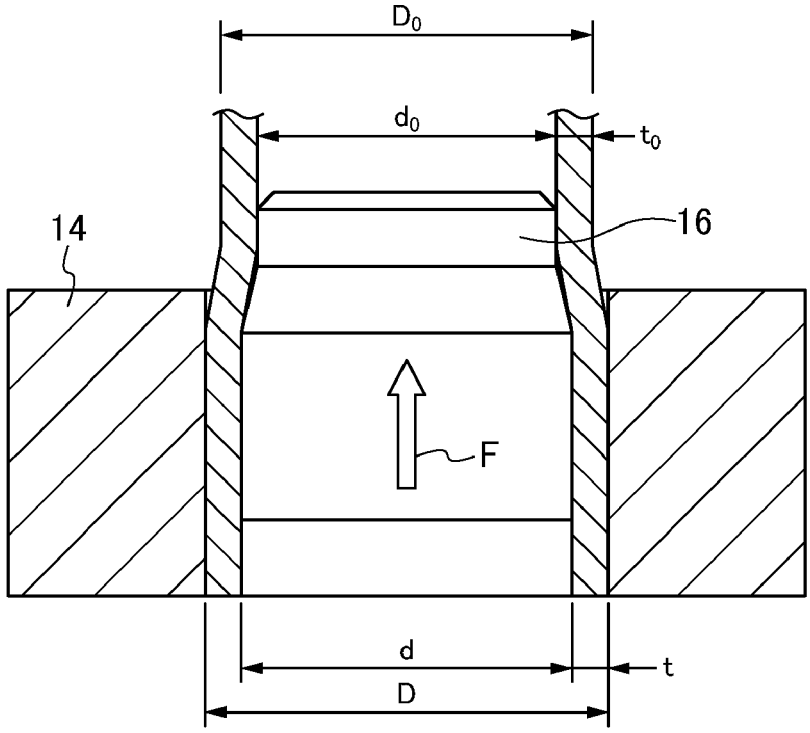
FIG. 4 is a schematic view showing an ironing operation by a die and a punch.
Figure 5B:
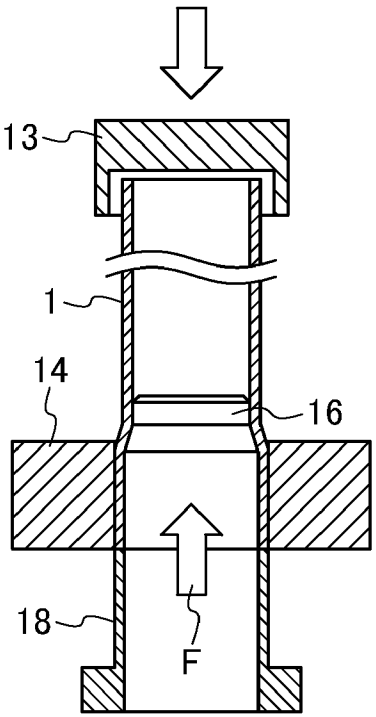

(2) The punch 16 moved forward by the punch hydraulic cylinder apparatus 15 is inserted to the other end of the damper tube 1 so as to be propelled, and the other end of the damper tube 1 is expanded (D>D0, d>d0) while ironing (t<t0)

as shown in FIG. 4 (FIG. 5B). The damper tube 1 is elongated at a thinned amount by the ironing work (for example, about 2 to 3 mm). A fixed thrust force F is applied to the punch 16 by the punch hydraulic cylinder apparatus 15, and the punch 16 is propelled a fixed stroke (a tube expanding depth). The stopper 13 is retained in the fixed position mentioned in the item (1) by the contraction lock mentioned in the item (1) of the stopper hydraulic cylinder apparatus 12, and supports the thrust force F of the punch 16 applied to the damper tube 1.

Figure 5C:
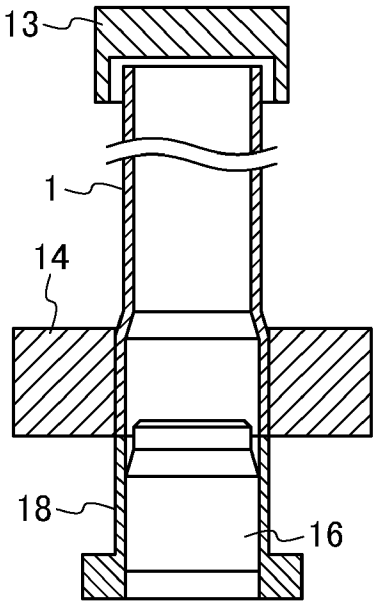

(3) The tube expansion is finished by moving the punch 16 backward by the punch hydraulic cylinder apparatus 15 so as to pull out from the expanded tube opening portion of the damper tube 1 (FIG. 5C).

Figure 5D:
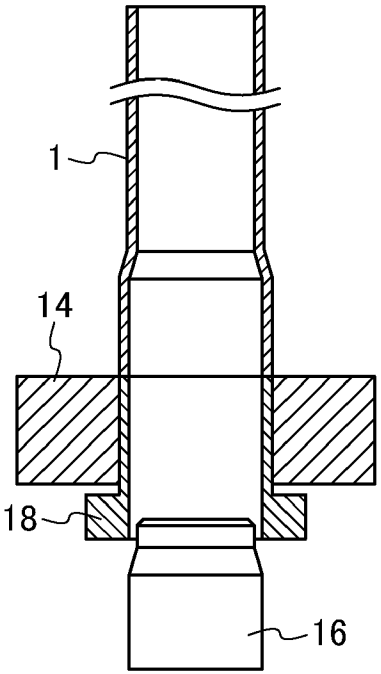

(4) The ejector 18 is moved forward from the ejector hydraulic cylinder apparatus 17, and the expanded damper tube 1 is pushed out to the die 14 (FIG. 5D). Since the damper tube 1 after being expanded is elongated at the thinned amount by the ironing work mentioned in the item (2), one end thereof is cut and removed so as to align a whole length of the damper tube 1 with a fixed length.

Accordingly, in order to tube expand the damper tube 1 in the tube expanding step mentioned in the item (2) without buckling, the tube expanding apparatus 10 is provided with the following structure. In other words, the tube expanding apparatus 10 previously calculates a buckling load B of the damper tube 1 on the basis of a raw material, a whole length, an ironing amount (t0−t), a tube expanding depth of the damper tube 1, a punch thrust force and the like so as to forecast, and previously determine a critical load A (A=0.8 B) obtained by multiplying the buckling load B, for example, by a safety constant 0.8 corresponding to a safety ratio 20%. Further, the tube expanding apparatus 10 has a stopper releasing means 20 for releasing the stopper 13 at the elongated amount of the damper tube 1 at a time when the load in the axial direction applied to the damper tube 1 gets over the critical load A mentioned above due to the elongation caused by the ironing work mentioned in the item (2) of the damper tube 1.

In the present embodiment, the stopper releasing means 20 is structured, as shown in FIG. 2, such as to have the stopper hydraulic cylinder apparatus 12 supporting the stopper 13, and a pressure control valve 21 relieving the hydraulic pressure generated in the oil chamber of the stopper hydraulic cylinder apparatus 12 while the load in the axial direction applied to the damper tube 1 increases over the critical load A mentioned above, and contracting the stopper hydraulic cylinder apparatus 12 at the elongated amount of the damper tube 1. In a hydraulic circuit in FIG. 2, a pressure gauge 21A detects the hydraulic pressure generated in the oil chamber of the stopper hydraulic cylinder apparatus 12, the pressure control valve 21 constituted by an electromagnetic valve is opened only when the detected hydraulic pressure increases over a corresponding pressure to the critical load A, the oil in the oil chamber of the stopper hydraulic cylinder apparatus 12 is returned to the tank 12C, and the hydraulic cylinder apparatus 12 and the stopper 13 are pushed back at the elongated amount of the damper tube 1 so as to be released.

In accordance with the present embodiment, the following operations and effects can be achieved.

(a) The stopper 13 is released at the elongated amount of the damper, when the load in the axial direction applied to the damper tube 1 caused by the elongation of the damper tube 1 by the ironing operation increases over the critical load A which is previously determined so as to come to the smaller load than the buckling load B expected in the damper tube 1, in the case of the tube expansion of the damper tube 1. Accordingly, the load in the axial direction applied to the damper tube 1 does not get over the buckling load B of the damper tube 1, and it is possible to expand the damper tube 1 without buckling. It is possible to improve a simplification of a facility and a freedom of the raw material, without preparing any inner and outer diameter constraining means of the damper tube 1.

(b) It is possible to accurately expand the inner and outer diameters of the damper tube 1 on the basis of the ironing work of the damper tube 1 using the die 14 and the punch 16. It is preferable to set the length after expanding the damper tube 1 to be longer than a necessary length, and it is possible to easily secure a necessary length by cutting and removing one end.

(c) The critical load A of the damper tube 1 is previously determined by multiplying the buckling load B expected on the basis of the raw material, the whole length, the ironing amount and the tube expanded depth of the damper tube 1, the thrust force of the punch 16 and the like by the safety constant. It is possible to easily correspond to the various damper tubes 1 by setting the relief pressure of the pressure control valve 21 constructing the stopper releasing means 20 in such a manner as to correspond to the critical load A which is previously determined about the damper tube 1 to be expanded at this time, and it is possible to expand the damper tube 1 without buckling.

As heretofore explained, embodiments of the present invention have been described in detail with reference to the drawings. However, the specific configurations of the present invention are not limited to the embodiments but those having a modification of the design within the range of the present invention are also included in the present invention. For example the stopper releasing means 20 may be structured such as to support the stopper 13 on the basis of an elastic body such as a spring, a rubber or the like which is elastically compressed by the critical load A, or may be structured such that the elastic body is interposed between the stopper hydraulic cylinder apparatus 12 and the stopper 13. Further, the fluid pressure cylinder apparatus constructing the stopper releasing means is not limited to the hydraulic cylinder apparatus, but may be constituted by a pneumatic cylinder apparatus.

In accordance with the present invention, in a damper tube having a low yield strength in an axial direction such as a tube in which a bulging work is applied to a thin tube or a tube intermediate portion, the tube expanding work accompanying the ironing work can be carried out.

Although the invention has been illustrated and described with respect to several exemplary embodiments thereof, it should be understood by those skilled in the art that the foregoing and various other changes, omissions and additions may be made to the present invention without departing from the spirit and scope thereof. Therefore, the present invention should not be understood as limited to the specific embodiment set out above, but should be understood to include all possible embodiments which can be embodied within a scope encompassed and equivalents thereof with respect to the features set out in the appended claims.

What is claimed is:

1. A tube expanding method for a damper tube, comprising the steps of: supporting a thrust force of a punch applied to the damper tube by a stopper while retaining one end of the damper tube by the stopper, inserting an other end of the damper tube to a die, inserting the punch to the other end of the damper tube so as to propel, and expand the other end of said damper tube while carrying out an ironing operation; releasing the stopper when a load in an axial direction applied to said damper tube due to an elongation by the ironing operation of the damper tube increases over a critical load which is previously determined to be a smaller load than an expected buckling load in the damper tube; and wherein a whole length of said damper tube is set to a fixed length by cutting and removing one end of said damper tube after expanding said damper tube.

2. A tube expanding apparatus of a damper tube supporting a thrust force of a punch applied to the damper tube by a stopper while retaining one end of the damper tube by the stopper, inserting an other end of the damper tube to a die, inserting the punch to the other end of the damper tube so as to propel, and expand the other end of said damper tube while carrying out an ironing operation, wherein the apparatus is provided with a stopper releasing means for releasing the stopper when a load in an axial direction applied to said damper tube due to an elongation by the ironing operation of the damper tube increases over a critical load which is previously determined to be a smaller load than an expected buckling load in the damper tube; and wherein a whole length of said damper tube is set to a fixed length by cutting and removing one end of said damper tube after expanding said damper tube.

3. The tube expanding apparatus of a damper tube according to claim 2, wherein said stopper releasing means has a fluid pressure cylinder apparatus supporting the stopper, and a pressure control valve relieving a fluid pressure generated in said fluid pressure cylinder apparatus when the load in the axial direction applied to the damper tube increases over said critical load so as to contract said fluid pressure cylinder apparatus.

4. A hydraulic shock absorber of a damper tube according to claim 2, wherein said stopper releasing means is structured such that an elastic body elastically compressing on the basis of said critical load is interposed between said fluid pressure cylinder apparatus and said stopper.

* * * * *